US005706548A

United States Patent [19]

Schabacker

[11] Patent Number: 5,706,548

[45] Date of Patent: Jan. 13, 1998

[54] PRESSURE WASHER

[76] Inventor: Nolan D. Schabacker, 226 S. Price Rd., Tempe, Ariz. 85281

[21] Appl. No.: 556,075

[22] Filed: Nov. 13, 1995

[51] Int. Cl.[6] ..... B05B 1/28; A47L 7/00

[52] U.S. Cl. ..... 15/322; 15/345; 15/354; 15/395

[58] Field of Search ..... 15/321, 322, 345

[56] References Cited

U.S. PATENT DOCUMENTS

| | | | |
|---|---|---|---|
| D. 141,623 | 6/1945 | Thompson . | |
| D. 243,610 | 3/1977 | Craig . | |
| 2,746,072 | 5/1956 | Lumpkin . | |
| 2,784,030 | 3/1957 | Dietzel . | |
| 3,161,900 | 12/1964 | Hornschuch et al. | 15/345 |
| 3,678,534 | 7/1972 | Hilbig | 15/345 |
| 3,913,837 | 10/1975 | Grant . | |
| 3,931,931 | 1/1976 | Otis . | |
| 4,023,233 | 5/1977 | Prestwich | 15/320 |
| 4,095,746 | 6/1978 | Anderberg et al. . | |
| 4,392,270 | 7/1983 | Magee | 15/322 |
| 4,596,061 | 6/1986 | Henning | 15/322 |
| 5,028,004 | 7/1991 | Hammelmann | 15/322 X |
| 5,125,126 | 6/1992 | Bonnant | 15/322 X |
| 5,127,128 | 7/1992 | Lee | 15/322 |
| 5,321,869 | 6/1994 | Kaempf | 15/322 |
| 5,460,657 | 10/1995 | Ally | 15/345 X |

*Primary Examiner*—Chris K. Moore
*Attorney, Agent, or Firm*—John D. Lister

[57] ABSTRACT

A pressure washer sprays a pressurized liquid into a groove of a pavement, floor or similar surface to remove dirt and debris from the groove. The dirt and debris dissolves and/or becomes suspended in the liquid and is then removed from the pressure washer for disposal. The pressure washer includes a cleaning hood with a cover plate and a skirt that extends downward from the periphery of the cover plate to form a less than air tight seal with the surface containing the groove. A spray nozzle in a forward portion of the cover plate directs the pressurized liquid spray downward into the groove, where the liquid picks up dirt and debris to form a liquid suspension and/or solution, and preferably, rearward toward an exhaust port which removes the liquid suspension and/or solution of dirt and debris from the cleaning hood. A handle extends upward from the cleaning hood for guiding the pressure washer. The handle also carries a pressurized liquid supply line connected to the spray nozzle and a vacuum line connected to the exhaust port.

15 Claims, 2 Drawing Sheets

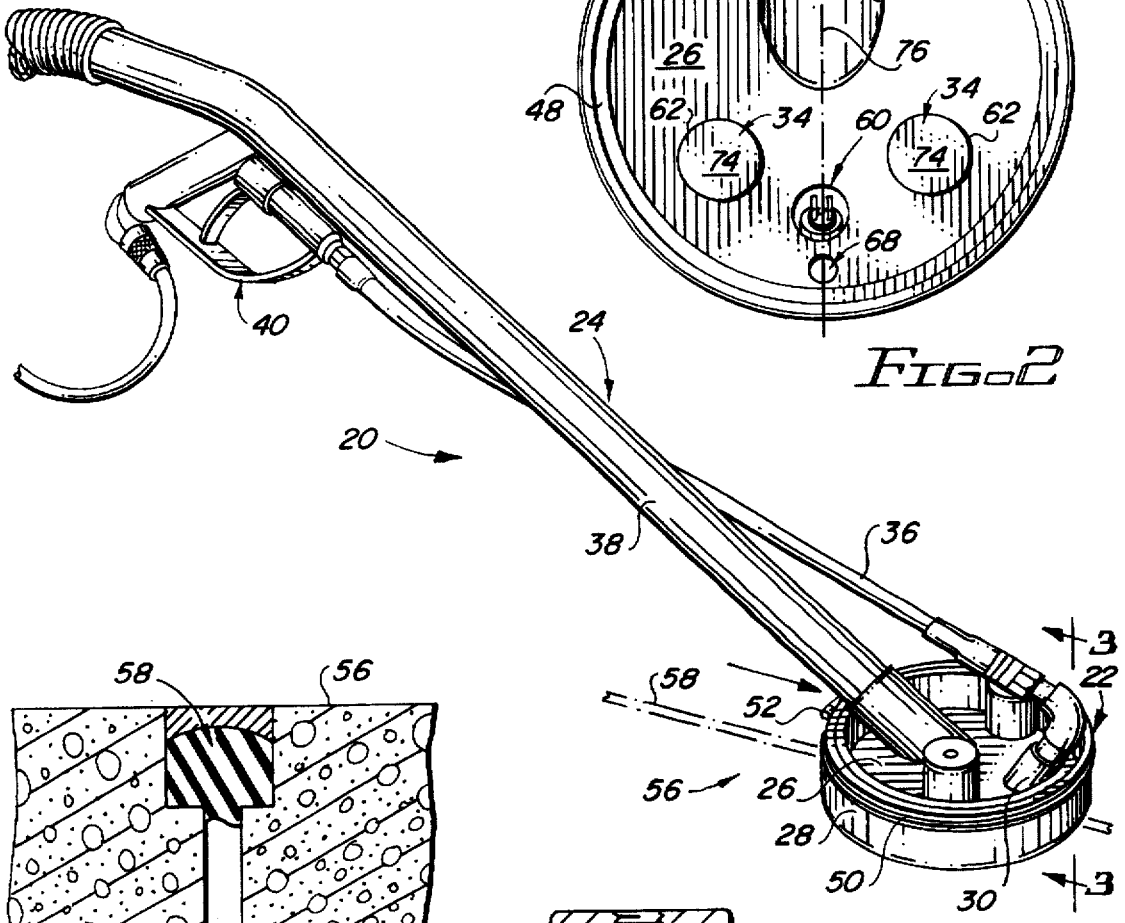
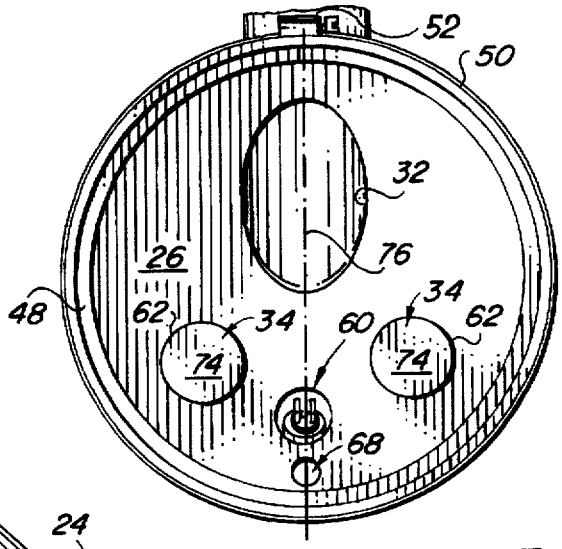
FIG. 2
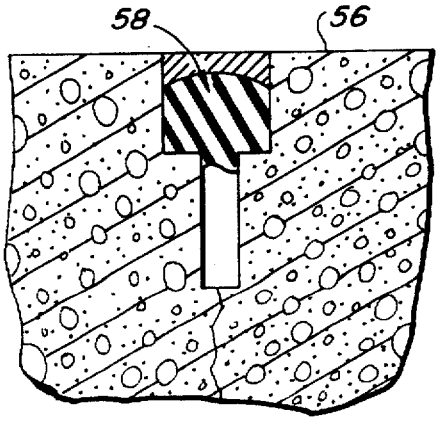
FIG. 6
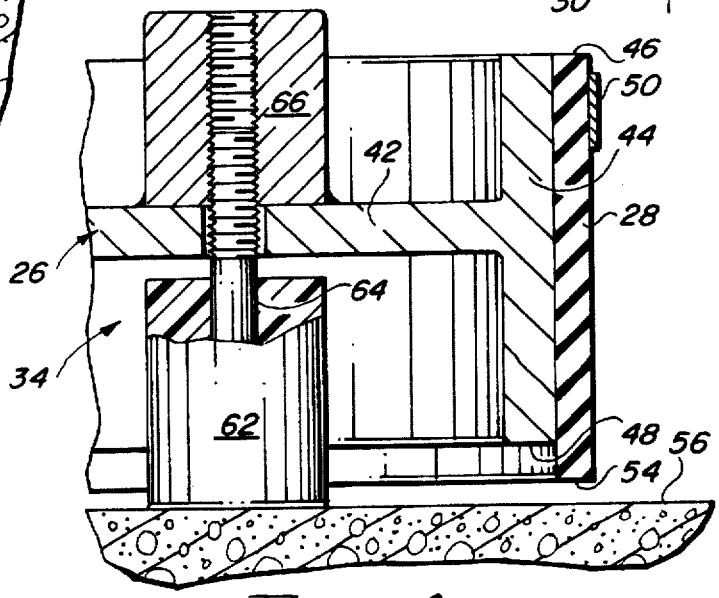
FIG. 4

PRESSURE WASHER

BACKGROUND OF THE INVENTION

The present invention relates to a pressure washer and, in particular, to a pressure washer for cleaning dirt and debris from grooves in pavements, floors and similar surfaces made of concrete asphalt and similar materials.

When constructing highway pavements, runway pavements, hanger floors, warehouse floors and similar surfaces of concrete, stress relieving grooves are typically cut into such surfaces before the concrete cures to control the formation of fissures or cracks in the surface as the concrete contracts. These grooves are commonly referred to as contraction joints. Grooves are also cut into concrete or asphalt road surfaces at road intersections and entrances to parking lots or garages and the like to install sensors and wiring for operating traffic control lights, gates or other control devices. After the grooves are cut into such surfaces by a saw or similar tool, dirt and debris formed by cutting the grooves and otherwise introduced into the grooves must be removed prior to installing any sensors and/or wiring conduit in the grooves and/or filling the grooves with pliable materials that permit the repeated expansion and contraction of the surfaces on either side of the grooves.

Such grooves are presently cleaned out by directing water from a hose into the groove and onto the surfaces on either side of the groove. With this groove cleaning procedure, the quality of the cleaning job is very dependent upon the care exercised by the worker in performing his task. In addition, as the water flows away from the groove, the dirt and debris removed from the groove by the water spreads out over the surface on either side of the groove where the dirt and debris are deposited as the water evaporates. The resulting layer of very fine dust particles and other debris on the roadway, runway, floor or similar surface is unsightly and, if not later removed after the surface drys, creates an environmental problem as the dust particles and debris from the layer become airborne, e.g. when vehicles pass over the surface or the wind blows over the surface. Of course, if the layer of dirt and debris is removed after the water evaporates, care should be taken that the workers handling the cleanup are protected from inhaling the dust and debris. An additional problem which may be encountered in this type of a cleanup is the reintroduction of portions of the dust and debris back into the grooves through the carelessness of the worker in directing the stream of water from the hose onto the groove and surrounding area and/or the flow of some of the water containing the dirt and debris back into the groove due to the inclination of the surfaces on either side of the groove.

There are water sweepers or sprayers for washing off concrete pavements and similar surfaces such as those disclosed U.S. Pat. No. 2,746,072, inventor Lumpkin, issued May 22, 1956; U.S. Pat. No. 2,784,030, inventor Dietzel, issued Mar. 5, 1957; U.S. Pat. No. 3,913,837, inventor Grant, issued Oct. 21, 1975; U.S. Pat. No. 3,931,931, inventor Otis, issued Jan. 13, 1976; U.S. Pat. No. 4,095,746, inventors Anderberg et al, issued Jun. 20, 1978; U.S. Des. Pat. No. 141,623, inventor Thompson, issued Jun. 19, 1945; and U.S. Des. Pat. No. 243,610, inventor Craig, issued Mar. 8, 1977. These sweepers and sprayers wash a surface by moving dirt and debris, found on the surface, across the surface with streams water, but do not dispose of the liquid suspension and/or solution of dirt and debris created by spraying the streams of water across the surface.

It is an object of the present invention to provide a pressure washer which is economical to manufacture and operate and specifically designed to remove dirt and debris from grooves in surfaces, such as concrete or asphalt pavements and floors.

It is a further object of the present invention to provide a pressure washer which not only effectively removes dirt and debris from grooves in surfaces such as concrete or asphalt pavements and floors, but also confines the cleaning liquid to a small area during the cleaning process and disposes of the liquid solution and/or suspension of dirt and debris. An accumulation of dirt and debris, temporarily dissolved and/or suspended in the cleaning liquid, is not left on or near the surface containing the groove to later cause environmental problems when the liquid evaporates leaving a layer of dust and other debris which can become airborne if not carefully cleaned up.

It is a further object of the present invention to provide a pressure washer for removing dirt and debris from grooves which is easy for the worker to operate and accurately guide along the length of a groove to thereby assure that the dirt and debris is removed from the groove along the entire length of the groove.

SUMMARY OF THE INVENTION

These and other objects and advantages are provided by the pressure washer of the present invention which sprays a pressurized liquid directly into a groove to remove dirt and debris from the groove. The dirt and debris dissolves and/or becomes suspended in the liquid; the liquid solution and/or suspension of dirt and debris is confined within the pressure washer; and then the liquid solution and/or suspension of dirt and debris is removed from the pressure washer for disposal.

The pressure washer of the present invention includes a cleaning hood comprising a cover plate and a skirt, depending from the periphery of the cover plate, which forms a less than air tight seal with the surface containing the groove being cleaned. A spray nozzle in a forward portion of the cover plate directs a pressurized liquid spray downward into the groove and preferably, rearward toward an exhaust port located in the cover plate rearward of the spray nozzle. Dirt and debris in the groove dissolves and/or becomes suspended in the liquid sprayed from the nozzle to form a liquid solution and/or suspension of the dirt and debris which is removed from beneath the hood through the exhaust port for disposal. A handle extends upward from the cleaning hood for manipulating and moving the pressure washer along the groove. Preferably, the handle also carries a pressurized liquid supply line which is connected to the spray nozzle and a vacuum line which is connected to the exhaust port for connecting the pressure washer to a source of pressurized liquid and a vacuum unit, respectively.

BRIEF DESCRIPTION OF THE DRAWINGS

FIG. 1 is a perspective view of a preferred embodiment of the pressure washer of the present invention.

FIG. 2 is a bottom view of the pressure washer of FIG. 1.

FIG. 4 is a partial section of the cleaning hood of FIG. 3, contained within the circled portion of FIG. 3.

FIG. 6 is a cross section through a typical groove that is cleaned by the pressure washer of the present invention, after the groove has been cleaned and a pliable filler placed in the groove to permit expansion and contraction of the surfaces on either side of the groove while preventing dirt and other debris from being introduced into the groove.

DESCRIPTION OF THE PREFERRED EMBODIMENTS

Figure 3:
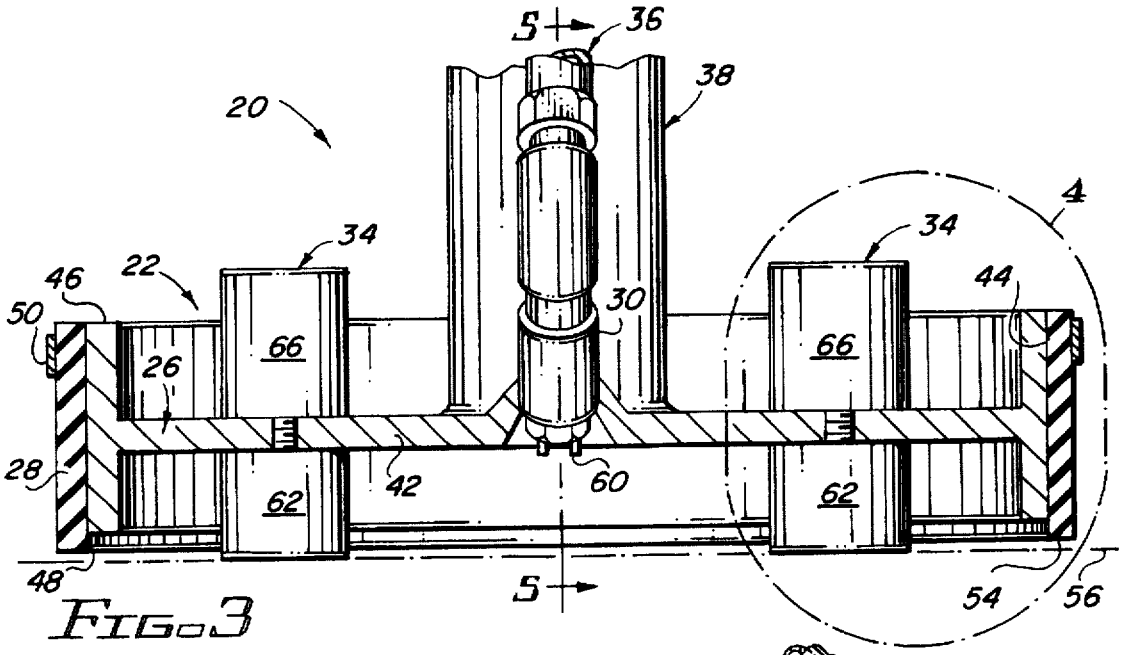
FIG. 3 is a section of the cleaning hood of the pressure washer of FIG. 1, taken substantially along lines 3—3 of FIG. 1.

As shown in FIG. 1, the pressure washer 20 of the present invention comprises a cleaning hood 22 and a handle assembly 24. The cleaning hood includes a cover plate 26, a peripheral skirt 28, a nozzle assembly 30, an exhaust port 32 and, preferably, both adjustable spacer elements 34 and a guide assembly 68 for keeping the pressure washer centered over a groove being cleaned. The handle assembly, preferably, includes a pressurized liquid supply line 36, an exhaust conduit 38 and a control mechanism 40.

FIGS. 2–5 show the cleaning hood 22 of the pressure washer 20 in detail. As shown, the cover plate 26 includes a flat or substantially flat circular disk 42 and an integral, annular sidewall 44 made of stainless steel, aluminum, a durable plastic or some similar material. The circular disk 42 intersects the sidewall 44 intermediate the upper and lower annular edges 46 and 48 of the sidewall and, as shown, intersects the annular sidewall about midway between the upper and lower edges of the annular sidewall. The annular sidewall 44 functions as a reinforcing flange to rigidify the cleaning hood 22 and as a means for securing the peripheral skirt 28 to the cover plate 26 of the cleaning hood.

Figure 5:
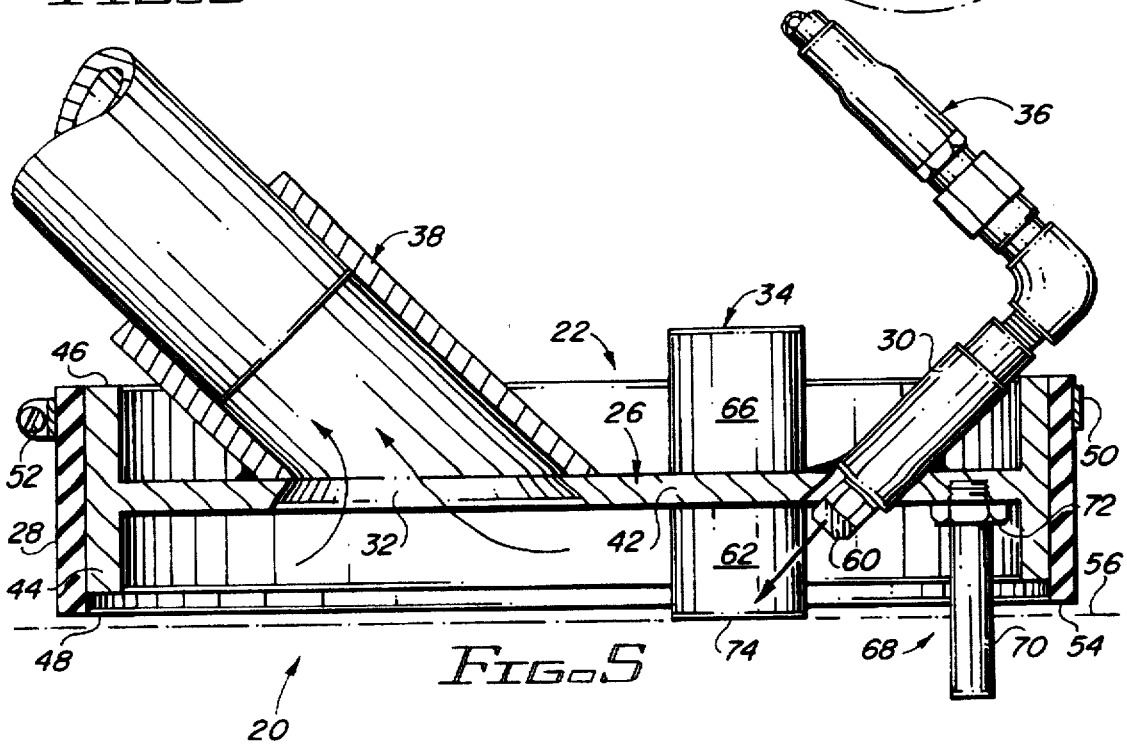
FIG. 5 is a section of the cleaning hood taken substantially along lines 5—5 of FIG. 3.

Preferably, the peripheral skirt 28 is formed of an annular sheet of a flexible, pliable or rubberlike material. This type of skirt performs well, is inexpensive, is easy to install and adjust on the cleaning hood 22, and is durable. As shown, the peripheral skirt 28 is adjustably secured to the outer surface of the annular sidewall 44 by an annular clamp 50. The annular clamp 50 has free ends which are secured together by a fastener 52. The fastener typically comprises a bolt mounted on one free end of the clamp 50 which is threadably received within a nut mounted on the other free end of the clamp. The clamp is tightened about the peripheral skirt 28 and the annular sidewall 44, to hold the peripheral skirt in place on the cover plate 26, by threading the bolt into the nut. By unthreading the bolt from the nut, the clamp 50 is easily loosened to permit the peripheral skirt to be removed for replacement or adjusted vertically relative to the annular sidewall 44. As best shown in FIGS. 3–5, the lower annular edge 54 of the peripheral skirt 28 extends below the lower annular edge 48 of the annular sidewall 44 to form a partial or less than air tight seal with the surface 56 containing the groove 58 being cleaned by the pressure washer 20. While the peripheral skirt is preferably made of a strip or annular piece of a flexible, pliable or rubberlike material, the peripheral skirt can also be made of a brush or similar means for effecting a partial or less than air tight seal with the surface 56.

As best shown in FIGS. 1, 2 and 5, the nozzle assembly 30 is located at the forward portion of the cleaning hood 22 and, preferably, is centered on a common centerline with the exhaust port 32. The nozzle assembly 30 is a conventional, commercially available, nozzle assembly which extends through and is welded or otherwise secured to the forward portion of the cover plate 26. The nozzle assembly 30 is supplied with a pressurized liquid, typically at pressures of from about 500 psig to about 1,000 psig, from a source of pressurized liquid through the supply line 36 that is generally carried by the handle assembly 24 to facilitate the handling of the pressure washer by the worker.

The nozzle outlet 60 is directed downward and, preferably, rearward toward the exhaust port 32. Thus, the pressurized cleaning liquid, typically water, is sprayed downward into the groove 58 and, preferably, rearward toward the exhaust port 32 to facilitate the removal of the liquid solution and suspension of dirt and debris, formed by spraying the liquid into the groove 58, through the exhaust port 32. The groove 58 is typically from about 0.125 and to about 0.50 inches wide by about 1.0 to about 3.0 inches deep. The spray pattern of the nozzle outlet 60, preferably, focuses the pressurized liquid stream into the groove 58 and concentrates the pressurized liquid stream across a width somewhat greater than the width of groove 58 being cleaned. The force of the pressurized liquid stream against the dirt and debris, clinging to the sidewalls of the groove and the bottom of the groove, causes the dirt and debris to be effectively detached from the sidewalls and bottom of the groove and picked up by the liquid where the dirt and debris either dissolves into solution or becomes suspended within the liquid to form the liquid solution and/or suspension of dirt and debris which is removed from the cleaning hood through the exhaust port for disposal.

As mentioned above, the exhaust port 32 is located in the cover plate rearward of the spray nozzle assembly 30 and, preferably, is centered on a common centerline with the spray nozzle 30 that extends from the front of the cleaning hood to the rear of the cleaning hood. The exhaust conduit 38, which preferably also functions as the handle, connects the exhaust port to a wet-dry vacuum, such as GRABBER POWER PRODUCTS Wet-Dry Vacuum having a typical capacity of from about 100 to about 200 cubic feet/minute. Thus, the liquid solution and/or suspension of dirt and debris created by cleaning out the groove 58 is delivered to a receptacle for proper disposal.

Preferably, the cleaning hood 22 is also provided with a pair of adjustable spacer elements 34, such as the one illustrated in FIG. 3. As shown, each spacer element 34 comprises a cylindrical head 62 having a threaded shaft 64 which is threadably received in a nut 66 welded or otherwise secured to the cover plate 26. The cylindrical head 62 and nut 66 are, preferably, made of stainless steel, aluminum, a hard rubber or plastic material. The adjustable spacer elements 34 are, preferably, located in the forward portion of the cleaning hood on either side of the centerline passing through the nozzle assembly 30 and the exhaust port 32.

Preferably, the cleaning hood 22 is also provided with a guide assembly 68. The guide assembly 68 is located in the forward portion of the cleaning hood, forward of the spray nozzle assembly, and is centered on the same centerline 76 that the nozzle assembly 30 and exhaust port 32 are centered. As shown, the guide assembly 68 includes a guide element 70 which is threaded into a threaded aperture in the cover plate 26 and locked in place by means of a lock nut 72. The guide element 70 extends down below a horizontal plane containing the bottom surfaces 74 of the spacer elements 34 so that the guide element 70 extends below the surface 56 and into the groove 58 to keep the cleaning hood and thus, the spray nozzle assembly 30 and exhaust port 32 centered over the groove 58 while the groove is being cleaned. The distance that the guide element 70 extends below the plane containing the bottom surfaces 74 of the adjustable spacer elements 34 (e.g. 0.50 inch to about 1 inch) and the width or diameter of the guide element 70 (e.g. from less than 0.125 to about 0.50 inches) can vary depending on the depth and width of the groove 58. Preferably, the dimensions of the guide element are such that the guide element 70 will be readily received in the groove 58 with ample clearance to assure that the guide element can move freely along the length of the groove, between the sidewalls of the groove, without bottoming out on the bottom of the groove and with sufficient depth to keep the guide element 70 from accidentally coming out of the groove. While the guide element 70 is preferably cylindrical, the guide element can assume other configurations which will be readily received in and freely move along the length of the groove. The guide element 70 is typically made of stainless steel, aluminum, a hard rubber or plastic, or a similar material.

In use, the adjustable spacer elements 34 enable a worker to easily and quickly adjust the spacing between the lower annular edge 54 of the peripheral skirt 28 and the surface 56 containing the groove 58. The worker merely threads the cylindrical heads 62 into the nuts 66 a selected amount to reduce the spacing between the lower annular edge 54 of the peripheral skirt 28 and the surface 56 or unthreads the cylindrical heads from the nuts a selected amount to increase the spacing between the lower annular edge 54 of the peripheral skirt 28 and the surface 56.

If the lower annular edge 54 of the peripheral skirt 28 forms too tight of a seal with the surface 56, the vacuum being drawn through the exhaust port 32 causes the cleaning hood 22 to adhere or hold fast to the surface 56, as a result of suction, thereby making it difficult to move the cleaning hood along the surface. If the lower annular edge 54 of the peripheral skirt 28 is elevated too far above the surface 56, too much air is drawn into the cleaning hood from outside the cleaning hood thereby reducing the effectiveness of the vacuum being drawn through the exhaust port 32 and the removal of the liquid solution and/or suspension of dirt and debris from under the cleaning hood for disposal. By adjusting the spacing between the lower annular edge 54 of the peripheral skirt 28 and the surface 56, the proper balance (a less than air tight seal) can be obtained between an air tight seal which causes the cleaning hood 22 to adhere to the surface 56 and no seal where too much air is drawn into the cleaning hood 22 from outside the cleaning hood to thereby reduce the effectiveness of the vacuum being drawn through the exhaust port 32.

The control mechanism 40 mounted on the exhaust conduit 38 is a conventional, commercially available control mechanism which actuates a liquid flow control valve in the pressurized liquid supply line 36 and, if desired, an on/off switch for a wet-dry vacuum connected to the exhaust conduit 38. Otherwise, the wet-dry vacuum can be turned on separately and allowed to operate during the cleaning operation.

In use, the worker connects the spray nozzle assembly 30 of the pressure washer 20 to a conventional source of pressurized liquid, e.g. water, by means of the pressurized liquid supply line 36 and the exhaust conduit 38 of the pressure washer to a wet-dry vacuum unit (not shown). If the spacing between the lower annular edge 54 of the peripheral skirt 28 and the surface 56 needs to be adjusted to a selected spacing by means of the adjustable spacer elements, the adjustment is quickly and easily made by tightening or loosening the cylindrical heads 62. Then, for the most effective cleaning action, the cleaning hood 22 is centered over the groove 58 to be cleaned, preferably, by aligning and centering the nozzle assembly 30 and exhaust port 32 over the groove through the use of the cylindrical guide element 70. This assures that the pressurized liquid, sprayed from the nozzle outlet 60, is sprayed downward directly into the groove to impact upon the dirt and debris within the groove and cause the dirt and debris to be picked up by the liquid where it dissolves into solution or becomes suspended. This alignment of the cleaning hood 22 over the groove 58 also assures that the liquid is directed rearward toward the exhaust port 32 which is also centered over the groove to most effectively remove the liquid solution and/or suspension of dirt and debris from the cleaning hood for disposal.

The peripheral skirt 28, in combination with the suction from the exhaust port 32, keeps the pressurized liquid sprayed from the nozzle assembly 30 confined or substantially confined beneath the cleaning hood until the liquid solution and/or suspension of dirt and debris created by the removal of the dirt and debris from the groove 58 is removed from the cleaning hood through the exhaust port 32 to the wet-dry vacuum unit for disposal. In addition to removing the liquid solution and/or suspension of dirt and debris from beneath the cleaning hood 22, the suction through the exhaust port 32, created by the wet-dry vacuum unit, also facilitates the removal of dirt and debris from deep within the groove 58.

To clean out the groove 58, the worker merely guides the cleaning hood 22 of the pressure washer 20 along the length of the groove 58. When the cleaning operation is completed, the dirt and debris has been removed from the groove 58 and the surface area immediately adjacent the groove without leaving a residue of dirt and debris on the surface 56 for later removal or to cause environmental problems.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A pressure washer for cleaning dirt and debris out of grooves in concrete, asphalt and similar surfaces, comprising:

a cleaning hood; said cleaning hood having a cover plate; said cover plate having a spray nozzle therein which is directed in a downward direction for spraying a liquid downward, under pressure, into a groove to flush dirt and debris out of the groove and suspend and/or dissolve the dirt and debris in the liquid for removal; said cover plate having an exhaust port therein for withdrawing the liquid containing the suspended and/or dissolved dirt and debris; said cleaning hood having a skirt extending downward from a periphery of said cover plate to form a less than air tight seal with a surface containing the groove;

liquid supply line means for connecting said spray nozzle of said cleaning hood to a source of the liquid under pressure;

handle means extending upward from and secured to said cleaning hood for manipulating said pressure washer; said handle means including exhaust conduit means for connecting said exhaust port of said cleaning hood to a vacuum means for creating a suction under said cleaning hood to withdraw the liquid containing the suspended and/or dissolved dirt and debris from said cleaning hood; and guide means extending below a lower edge of said skirt for guiding said cleaning hood along the groove to keep said spray nozzle and said exhaust port centered over the groove.

2. The pressure washer of claim 1, wherein: said spray nozzle is directed downward and generally toward a location beneath said exhaust port to thereby direct the liquid sprayed from said spray nozzle downward and generally toward said exhaust port to facilitate removal of the liquid containing the suspended and/or dissolved dirt and debris from said cleaning hood.

3. The pressure washer of claim 2, wherein: said spray nozzle is located in a forward portion of said cover plate and said exhaust port is located in said cover plate rearward of said spray nozzle.

4. The pressure washer of claim 1, wherein: said spray nozzle is located in a forward portion of said cover plate and said exhaust port is located in said cover plate rearward of said spray nozzle.

5. The pressure washer of claim 1, wherein: said spray nozzle has a spray pattern that emits a liquid spray having a width at least wide enough to contact both sidewalls of the groove being cleaned.

6. The pressure washer of claim 1, wherein: said skirt is made of a flexible material.

7. The pressure washer of claim 6, wherein: said flexible material is a rubberlike material.

8. The pressure washer of claim 1, wherein: said skirt is a brush.

9. The pressure washer of claim 1, wherein: the handle means includes said liquid supply line means and means for turning the supply of liquid under pressure on and off and includes means for turning the vacuum means on and off.

10. The pressure washer of claim 1, wherein: the liquid comprises water.

11. A pressure washer for cleaning dirt and debris out of grooves in concrete, asphalt and similar surfaces, comprising:

a cleaning hood; said cleaning hood having a cover plate; said cover plate having a spray nozzle therein for spraying a liquid under pressure into a groove to flush dirt and debris out of the groove and suspend and/or dissolve the dirt and debris in the liquid for removal; said cover plate having an exhaust port therein for withdrawing the liquid containing the suspended and/or dissolved dirt and debris; said spray nozzle being directed in a downward direction and toward a location beneath said exhaust port; said spray nozzle being located in a forward portion of said cover plate and said exhaust port being located in said cover plate rearward of said spray nozzle; said spray nozzle and said exhaust port being substantially centered on a centerline of said cleaning hood; said cleaning hood having a flexible skirt extending downward from a periphery of said cover plate to form a less than air tight seal with a surface containing the groove being cleaned; said cleaning hood having adjustable spacing means located in said forward portion of said cover plate on either side of said centerline for spacing said flexible skirt of said cleaning hood a selected distance above the surface containing the groove being cleaned to provide a less than air tight seal between a lower peripheral edge of said flexible skirt and the surface containing the groove being cleaned; said cleaning hood including a guide means, extending below said spacing means, to be received within the groove to keep said spray nozzle and said exhaust port substantially centered over the groove; and handle means extending upward from and secured to said cleaning hood; said handle means including a liquid supply line means for connecting said spray nozzle to a source of the liquid under pressure; and said handle means including an exhaust conduit means for connecting said exhaust port to a wet-dry vacuum means for creating a suction under said cleaning hood to withdraw the liquid containing the suspended and/or dissolved dirt and debris from said cleaning hood.

12. The pressure washer of claim 11, wherein: said flexible skirt is made of a rubberlike material.

13. The pressure washer of claim 11, wherein: said flexible skirt is a brush.

14. A pressure washer for cleaning dirt and debris out of grooves in concrete, asphalt and similar surfaces, comprising:

a cleaning hood; said cleaning hood having a cover plate; said cover plate having a spray nozzle therein which is directed in a downward direction for spraying a liquid downward, under pressure, into a groove to flush dirt and debris out of the groove and suspend and/or dissolve the dirt and debris in the liquid for removal; said cover plate having an exhaust port therein for withdrawing the liquid containing the suspended and/or dissolved dirt and debris; said cleaning hood having a skirt extending downward from a periphery of said cover plate to form a less than air tight seal with a surface containing the groove;

liquid supply line means for connecting said spray nozzle of said cleaning hood to a source of the liquid under pressure;

handle means extending upward from and secured to said cleaning hood for manipulating said pressure washer; said handle means including exhaust conduit means for connecting said exhaust port of said cleaning hood to a vacuum means for creating a suction under said cleaning hood to withdraw the liquid containing the suspended and/or dissolved dirt and debris from said cleaning hood; and spacing means for spacing said skirt of said cleaning hood a selected distance above the surface containing the groove being cleaned to provide a less than air tight seal between a lower peripheral edge of said skirt and the surface containing the groove being cleaned; said spacing means being adjustable whereby said selected distance may be changed.

15. The pressure washer of claim 14, wherein: guide means extends below said spacing means for guiding said cleaning hood along the groove to keep said spray nozzle and said exhaust port centered over the groove.

* * * * *